US005121286A

United States Patent [19]

Collins

[11] Patent Number: 5,121,286

[45] Date of Patent: Jun. 9, 1992

[54] AIR IONIZING CELL

[76] Inventor: Nelson H. Collins, 20 San Rafael, Pittsford, N.Y. 14618

[21] Appl. No.: 347,400

[22] Filed: May 4, 1989

[51] Int. Cl.[5] ..... H05F 3/06; H01T 19/04

[52] U.S. Cl. ..... 361/231; 361/213; 250/324

[58] Field of Search ..... 361/212, 213, 225, 229, 361/230, 231, 235, 226–228; 250/324–326, 423 R; 239/690, 702, 704, 707; 313/362.1

[56] References Cited

U.S. PATENT DOCUMENTS

| | | | |
|---|---|---|---|
| 3,054,553 | 9/1962 | White | 315/111.91 |
| 3,137,806 | 6/1964 | Schweriner | 361/230 |
| 3,156,847 | 11/1964 | Schweriner | 361/230 |
| 3,179,849 | 4/1965 | Schweriner | 361/230 |
| 3,283,209 | 11/1966 | Schutz | 361/230 |
| 3,611,030 | 10/1971 | Herbert | 361/230 |
| 3,619,719 | 11/1971 | Waller | 361/230 |
| 3,643,128 | 2/1972 | Testone | 361/230 |
| 4,139,302 | 2/1979 | Hung et al. | 356/32 |
| 4,139,879 | 2/1979 | Laws | 361/230 |
| 4,194,232 | 3/1980 | Cumming et al. | 361/213 |
| 4,213,167 | 7/1980 | Cumming et al. | 361/213 |
| 4,417,293 | 11/1983 | Larigaldie | 361/212 |
| 4,449,159 | 5/1984 | Schwab et al. | 361/230 |
| 4,478,370 | 10/1984 | Hastings | 239/707 |
| 4,488,045 | 12/1984 | Anazawa et al. | 250/423 R |
| 4,498,116 | 2/1985 | Saurenman | 361/213 |

*Primary Examiner*—A. D. Pellinen
*Assistant Examiner*—David Osborn
*Attorney, Agent, or Firm*—Mathews, Woodbridge & Collins

[57] ABSTRACT

An air ionizing cell has an elongated, hollow dielectic cylindrical body member, one end of which defines a greatly restricted orifice (relative to the inside diameter of the cylindrical body member). An elongated metallic electrode having an end tapered at a constant rate and terminating at a microscopically sharp point is disposed coaxially within the cylindrical body member. The point of the electrode is positioned concentrically within the orifice and an electrical potential is applied to the electrode without defining a corresponding ground within the cylindrical body member.

1 Claim, 2 Drawing Sheets

AIR IONIZING CELL

The present invention relates to an air ionizing cell, that is, a device for ionizing air or a similar gas passing through it.

BACKGROUND OF THE INVENTION

The problem associated with the generation of static electricity on various objects such as electronic components, paper products, photographic film, plastics, and the like is well known.

A number of solutions directed to this problem have been proposed. In one approach, a stream of ionized air is directed towards the surface to dispel the static charge and various devices to produce such a stream have been described for this purpose. Most of these devices employ one or more electrodes disposed in proximity to either a surface of opposed polarity or a ground so as to establish an electrical field. Air then is passed through this field, becomes ionized, and is directed towards the surface carrying the static charge.

U.S. Pat. No. 3,054,553 to White discloses an electrostatic blower apparatus in which a field is created by a voltage gradient between a field electrode and a corona discharge electrode.

U.S. Pat. No. 3,137,806 to Schweriner discloses a dustproof static eliminator in which a field is created between a needle and flat surface.

U.S. Pat. No. 3,156,847 to Schweriner discloses an ionizing air gun in which the ionizing field is set up by voltage differential between a needle and metal tip.

U.S. Pat. No. 3,283,209 to Schutz discloses a static eliminator in which the outer casing is grounded.

U.S. Pat. No. 3,611,030 to Herbert discloses an ionizing apparatus in which a conductive sleeve is disposed about an electrode.

U.S. Pat. No. 3,619,719 to Waller et al. discloses a static eliminator in which voltage is applied across an electrode and a metal surface hidden from the electrode.

U.S. Pat. No. 3,643,128 to Testone discloses an ionized air projector utilizing a grounded conductive tube.

U.S. Pat. No. 4,139,879 to Laws discloses an air ionization instrument in which a field is created between a needle and a flat plate.

U.S. Pat. No. 4,194,232 to Cumming et al. discloses an ion treatment of photographic film.

U.S. Pat. No. 4,449,159 to Schwab et al. discloses an electrostatic precipitator in which a high voltage is applied between an anode and a cathode.

One problem associated with such configurations is the internal arcing which tends to occur, thereby leading to erosion and malfunction of the device. To avoid internal arcing, the distance between the electrode and the surface of opposed polarity or a ground must be sufficiently great, the voltage must be reduced, and/or the power supply must be capacitance-coupled, each of which reduces the intensity of the ionization.

A second problem with such devices involves the attraction of dirt and dust to the surface of opposed polarity or a ground, eventually leading to malfunction or preventative shutdown for cleaning.

Finally, these devices tend to be expensive to fabricate.

DETAILED DESCRIPTION

The present air ionizing cell does not employ a surface of opposed polarity or a ground and therefore avoids the problems of arcing and dirt accumulation. Moreover, its simplified design greatly reduces the cost of materials and fabrication.

The nature of this invention will be apparent from the drawings in which.

Figure 1:
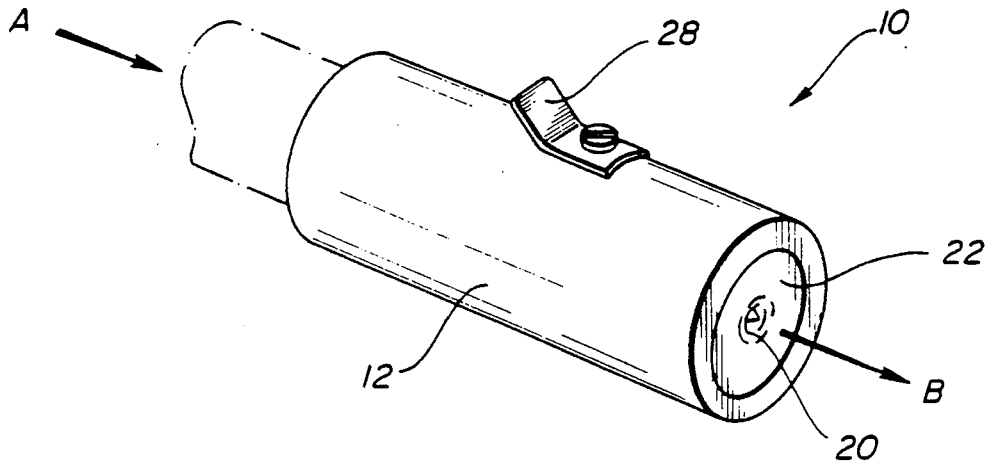
FIG. 1 is a perspective view of the device.
Figure 2:
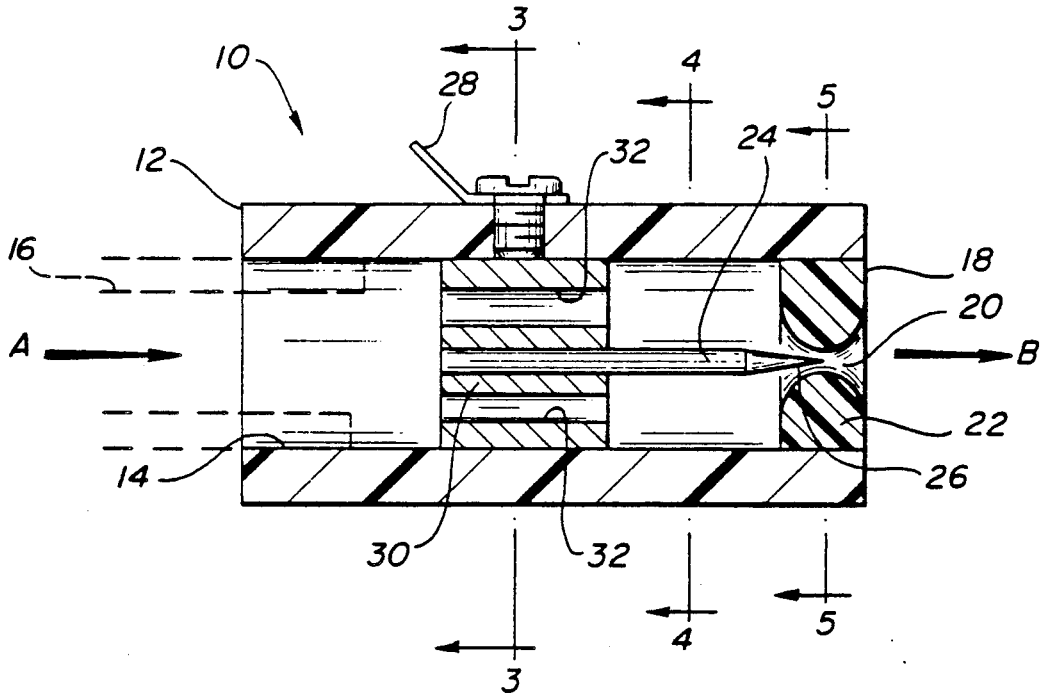
FIG. 2 is a longitudinal cross-sectional view of the device.
Figure 3:
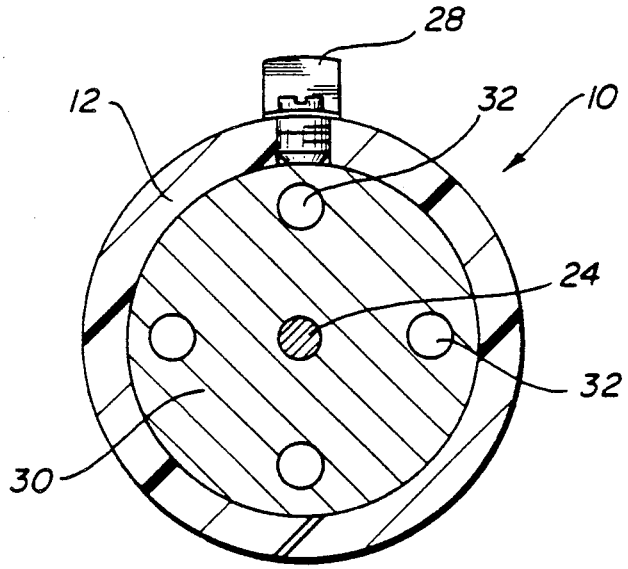
FIG. 3 is a transverse cross-sectional view of the device taken through line 3—3 of FIG. 2.
Figure 4:
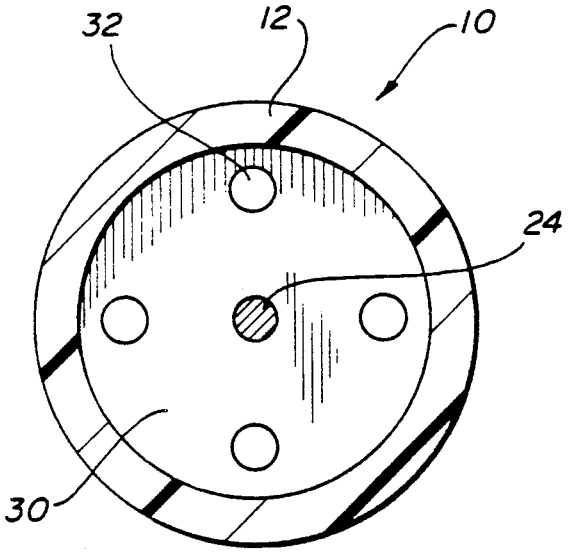
FIG. 4 is a transverse cross-sectional view of the device taken through line 4—4 of FIG. 2.
Figure 5:
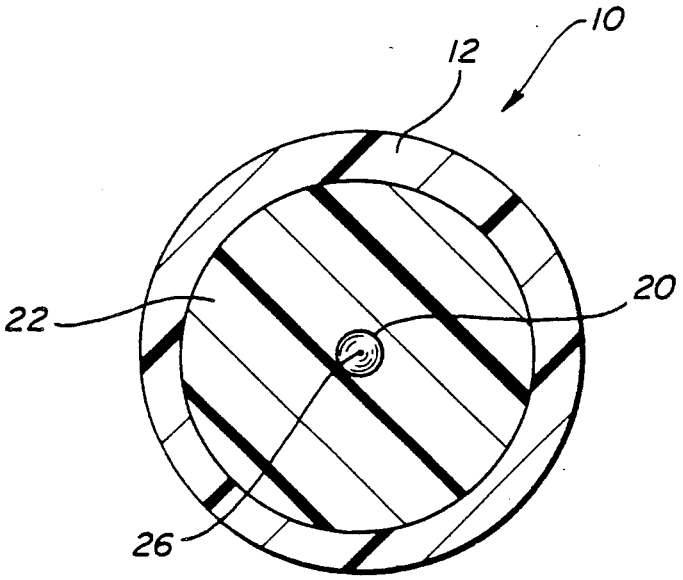
FIG. 5 is a transverse cross-sectional view of the device taken through line 5—5 of FIG. 2.

Referring now to the drawings in greater detail, FIGS. 1–5 show an air ionizing cell 10 comprising an elongated, hollow cylindrical body member 12. Body member 12 will be fabricated from a dielectric material such as ceramics or plastic, as for example polyvinyl chloride, polypropylene, ABS resin, or the like. Because of economies of manufacture, plastic is preferred.

A first end 14 of cylindrical body member 12 defines means operative to receive a stream of pressured air, shown generally at A, for passage through the interior of the cylindrical body member. These means can be a thread or "quick-connect" coupling suitable to receive mating conduit 16, shown in broken line. One advantage of the present device is that it can employ without adverse effect air which is moist or "dirty", that is, compressed air which has been neither dried nor purified, as is typically found in machine shops.

A second end 18 of cylindrical body member 12 defines orifice 20. This end also is dielectric and orifice 20 is greatly restricted relative to the inside diameter of cylindrical body member 12 but operative to permit exit of a stream of pressured air emerging from the interior of cylindrical body member 12 after ionization, shown generally at B. Typically orifice 20 will have a diameter of from about 0.05 to about 0.075 inch, ideally about 0.0625 inch (1/16 inch).

Second end 18 can be fabricated as part of cylindrical body member 12 so that cylindrical body member 12 is essentially cup-shaped with an open first end, a flat closed (other than orifice 20) second end, and an intermediate cylindrical wall. Alternatively, second end 18 of cylindrical body member 12 can be defined by plug 22 in which is defined orifice 20. In this second embodiment, plug 22 is fixedly attached to cylindrical body member 12 which can be fabricated from readily available cylindrical stock. This embodiment permits the optional use of a dielectric material for plug 22 different than that used to fabricate cylindrical body member 12. For example, if extended life is desired, plug 22 can be fabricated from a dielectric ceramic material whereas cylindrical body member 12 can be fabricated from a dielectric plastic material. Alternatively, plug 22 can be fabricated from the same material as is used for cylindrical body member 12, as for example plastic.

An elongated metallic electrode 24 is disposed coaxially within the interior of cylindrical body member 12. Electrode 24 has a first end 26 which is tapered at a constant rate and which defines at its terminus a microscopically sharp point. By "microscopically sharp point" is meant a point which displays no signs of blunting even under 200X magnification. Such a point can not be produced by normal machine shop techniques but must be generated by electrochemical etching. One method which has proven useful is to repeatedly immerse in, and withdraw from, an aqueous solution of a base (such as sodium hydroxide) a rod of the electrode metal, typically but not necessarily tungsten. The rod will be connected to the positive pole of a DC electrolysis circuit and will serve as the anode, with a cathode connected to the negative pole being disposed in the basic solution. After from about 20 to about 60 immersions, depending on the strength of the solution, a constant taper will be obtained (between the immersed tip of the rod and the zone of the rod in contact with the surface of the solution at maximum immersion) with a point which is microscopically sharp. The taper should be such as to be provide a constant slope of about 5 degrees from the longitudinal axis of the rod.

Means operative to selectively apply an electrical potential to electrode 24 without defining a corresponding ground within cylindrical body member 12 can include electrical contact 28 which communicated electrically with electrode 24. Electrical contact 28 is connected to a single AC line, typically 5 KV, which can be capacitance-coupled to provide a more uniform ion flow. The remaining AC lines of the power source are not connected to the device and in effect the air passing over the electrode serves as the ground.

Means operative to position the point of electrode 24 concentrically within orifice 20 also are provided. These electrode positioning means are fixedly attached to the interior of cylindrical body member 12 and also can be fabricated from dielectric material (not shown), in which case electrode 24 is electrically connected to electrical connection means 28. Alternatively, electrode positioning means 30 are conductive, as for example if fabricated from brass or aluminum, and electrical connection means 28 communicates electrically with electrode 24 through electrode positioning means 30. Thus electrical connection means 28 are fixedly disposed on the exterior of cylindrical body member 12 and communicate electrically therethrough to the interior to electrode positioning means 30. In this embodiment, electrode positioning means 30 includes at least one orifice 32, and preferrably several, of dimensions sufficient to permit passage of pressurized air from first end 14 of cylindrical body member 12 to second end 18 of cylindrical body member 12.

In operation, compressed air is introduced at end 14 as shown generally at A and emerges through orifice 20 shown generally at B after passing over electrode 24 and in particular the tip of tapered electrode portion 26 where it is ionized. Electrode 24 receives a potential through electrical connection means, 28, either directly or through electrode positioning means 30, but no surface of opposed polarity or ground is provided.

The device described herein thus operates without a ground and has been found to be more effective than any grounded device currently available. It can be readily fabricated at minimal cost, is tolerant to moisture and "dirty" air, and can be used with virtually any voltage without the risk of internal arcing.

What is claimed is:

1. An air ionizing cell comprising:

(a) an elongated, hollow dielectric cylindrical body member having first and second ends, a first end of said cylindrical body member defining means operative to receive a stream of pressured air for passage through the interior of said cylindrical body member;

(b) a plug fixedly attached to a second end of said cylindrical body member and having centrally defined therein a greatly restricted orifice relative to the inside diameter of said cylindrical body member and operative to permit exit of said stream of pressured air emerging from the interior of aid cylindrical body member;

(c) an elongated metallic electrode disposed coaxially within the interior of said cylindrical body member, said electrode having a first end tapered at a constant rate and defining at its terminus a microscopically sharp point;

(d) electrode positioning means operative to position the point of said electrode concentrically within the orifice of said plug, said electrode positioning means being electrically conductive, being fixedly attached to the interior of said cylindrical body member, and having a plurality of orifices of dimensions sufficient to permit unrestricted passage of pressurized air from said first end of said cylindrical body member to the orifice of said plug; and (e) electrical connection means disposed on the exterior of said cylindrical body member, said electrical connection means communicating through said cylindrical body member for electrical connection with said electrode positioning means without defining a corresponding ground within said cylindrical body.

* * * * *